US010876255B2

(12) United States Patent
Kunugi et al.

(10) Patent No.: US 10,876,255 B2
(45) Date of Patent: Dec. 29, 2020

(54) PROCESSING DEVICE, SHEET MANUFACTURING DEVICE, PROCESSING METHOD, AND METHOD FOR MANUFACTURING SHEET

(71) Applicant: SEIKO EPSON CORPORATION, Tokyo (JP)

(72) Inventors: Masanao Kunugi, Fujimi-machi (JP); Satomi Yoshioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 159 days.

(21) Appl. No.: 15/953,563

(22) Filed: Apr. 16, 2018

(65) Prior Publication Data

US 2018/0305870 A1 Oct. 25, 2018

(30) Foreign Application Priority Data

Apr. 24, 2017 (JP) ..... 2017-085118

(51) Int. Cl.
*D21D 5/18* (2006.01)
*D21B 1/08* (2006.01)
(Continued)

(52) U.S. Cl.
CPC ..... *D21H 11/14* (2013.01); *D21B 1/08* (2013.01); *D21C 5/027* (2013.01); *D21D 1/00* (2013.01); *D21D 1/20* (2013.01); *D21D 5/18* (2013.01)

(58) Field of Classification Search
CPC . D21B 1/08; D21B 1/021; D21B 1/04; D21B 1/325; D21D 1/20; D21D 1/00; D21D 5/18; D21C 5/027; D21H 11/14; D21F 9/00; Y02W 30/642; D04H 1/425; D04H 1/413; D04H 1/732; B27N 3/00; B27N 3/02; B27N 3/04; B27N 3/06
See application file for complete search history.

(56) References Cited

U.S. PATENT DOCUMENTS 5,011,091 A * 4/1991 Kopecky ..... D21B 1/08 241/259.1
5,225,041 A * 7/1993 Richard ..... D21D 1/20 162/80
(Continued)

FOREIGN PATENT DOCUMENTS

EP 3396059 A1 * 10/2018 ..... D21D 5/18
JP 02112500 A * 4/1990 ..... D21B 1/066
(Continued)

OTHER PUBLICATIONS

The Extended European Search Report for the corresponding European Patent Application No. 18168821.9 dated Jul 10, 2018.

*Primary Examiner* — Jose A Fortuna
(74) *Attorney, Agent, or Firm* — Global IP Counselors, LLP

(57) ABSTRACT

A processing device has a fibrillation portion fibrillating fiber-containing materials containing fibers in the air, a particle supply portion supplying particles having Mohs' hardness of 2 or more and 5 or less to the fiber-containing materials during or after the fibrillating at the fibrillation portion for collision of the particles and the fiber-containing materials, and a particle removal portion removing the particles from the fiber-containing materials to which the particles are supplied.

4 Claims, 11 Drawing Sheets

(51) Int. Cl.

| | |
|---|---|
| ***D21D 1/20*** | (2006.01) |
| ***D21D 1/00*** | (2006.01) |
| ***D21H 11/14*** | (2006.01) |
| ***D21C 5/02*** | (2006.01) |

(56) References Cited

U.S. PATENT DOCUMENTS

| | | | | |
|---|---|---|---|---|
| 7,726,592 | B2 * | 6/2010 | Fernandez | D21B 1/16 241/16 |
| 7,981,247 | B2 * | 7/2011 | Fernandez | D21B 1/021 162/22 |
| 9,790,642 | B2 * | 10/2017 | Nakamura | B07B 13/16 |
| 9,951,473 | B2 * | 4/2018 | Nakamura | D21B 1/08 |
| 2005/0133643 | A1 * | 6/2005 | Fernandez | D21B 1/021 241/16 |
| 2010/0186911 | A1 * | 7/2010 | Fernandez | D21B 1/16 162/26 |
| 2013/0221140 | A1 * | 8/2013 | Boltersdorf | D21B 1/04 241/23 |
| 2018/0305870 | A1 * | 10/2018 | Kunugi | D21H 11/14 |
| 2019/0203415 | A1 * | 7/2019 | Yoshioka | D21B 1/08 |
| 2019/0232606 | A1 * | 8/2019 | Ota | D21F 1/02 |
| 2020/0002894 | A1 * | 1/2020 | Higuchi | D21F 7/086 |

FOREIGN PATENT DOCUMENTS

| | | | | |
|---|---|---|---|---|
| JP | 2000-284657 | A | 10/2000 | |
| JP | 2018140547 | A * | 9/2018 | |
| JP | 2018184670 | A * | 11/2018 | D21D 1/00 |
| JP | 2018184671 | A * | 11/2018 | D21B 1/325 |
| JP | 2019119958 | A * | 7/2019 | |
| WO | 2005/056916 | A1 | 6/2005 | |

* cited by examiner

PROCESSING DEVICE, SHEET MANUFACTURING DEVICE, PROCESSING METHOD, AND METHOD FOR MANUFACTURING SHEET

CROSS-REFERENCE TO RELATED APPLICATIONS

This application claims priority to Japanese Patent Application No. 2017-085118 filed on Apr. 24, 2017. The entire disclosure of Japanese Patent Application No. 2017-085118 is hereby incorporated herein by reference.

BACKGROUND

Technical Field

The present invention relates to a processing device, a sheet manufacturing device, a processing method, and a method for manufacturing a sheet.

Related Art

In recent years, the environmental consciousness has increased, so that not only a reduction in the use amount of paper (recording medium) at the workplace but the recycling of paper at the workplace has been demanded.

As a method for recycling a recording medium, a method is known which includes ejecting a blast material to a recording layer (printing portion) of a used recording medium which contains a paper sheet and on which printing has been performed to remove the recording layer, for example (for example, JP-A-2000-284675). Then, the recording medium from which the recording layer is removed can be used again.

However, in the recycling method described in JP-A-2000-284675, a blast material is ejected in a state where the recording medium is in a sheet state, and therefore the blast material does not reach ink present in the deep side in the thickness direction of the recording medium, and, as a result, the ink cannot be sufficiently removed. Moreover, when it has been attempted to remove the ink, a long time for ejecting the blast material has needed to be secured, which has posed a problem that it takes a long time to remove the ink.

SUMMARY

An advantage of some aspects of the invention is to provide a processing device, a sheet manufacturing device, a processing device, and a method for manufacturing a sheet capable of quickly removing coloring materials when the coloring materials are contained in fiber-containing materials.

The invention has been made in order to solve at least some of the above-described problems and can be realized as the following aspects.

A processing device according to an aspect of the invention contains a fibrillation portion fibrillating fiber-containing materials containing fibers in the air, a particle supply portion supplying particles having Mohs' hardness of 2 or more and 5 or less to the fiber-containing materials during or after the fibrillating at the fibrillation portion for collision of the particles and the fiber-containing materials, and a particle removal portion removing the particles from the fiber-containing materials to which the particles are supplied.

BRIEF DESCRIPTION OF THE DRAWINGS

The invention will be described with reference to the accompanying drawings, wherein like numbers reference like elements.

Referring now to the attached drawings which form a part of this original disclosure.

DETAILED DESCRIPTION OF EXEMPLARY EMBODIMENTS

Figure 1:
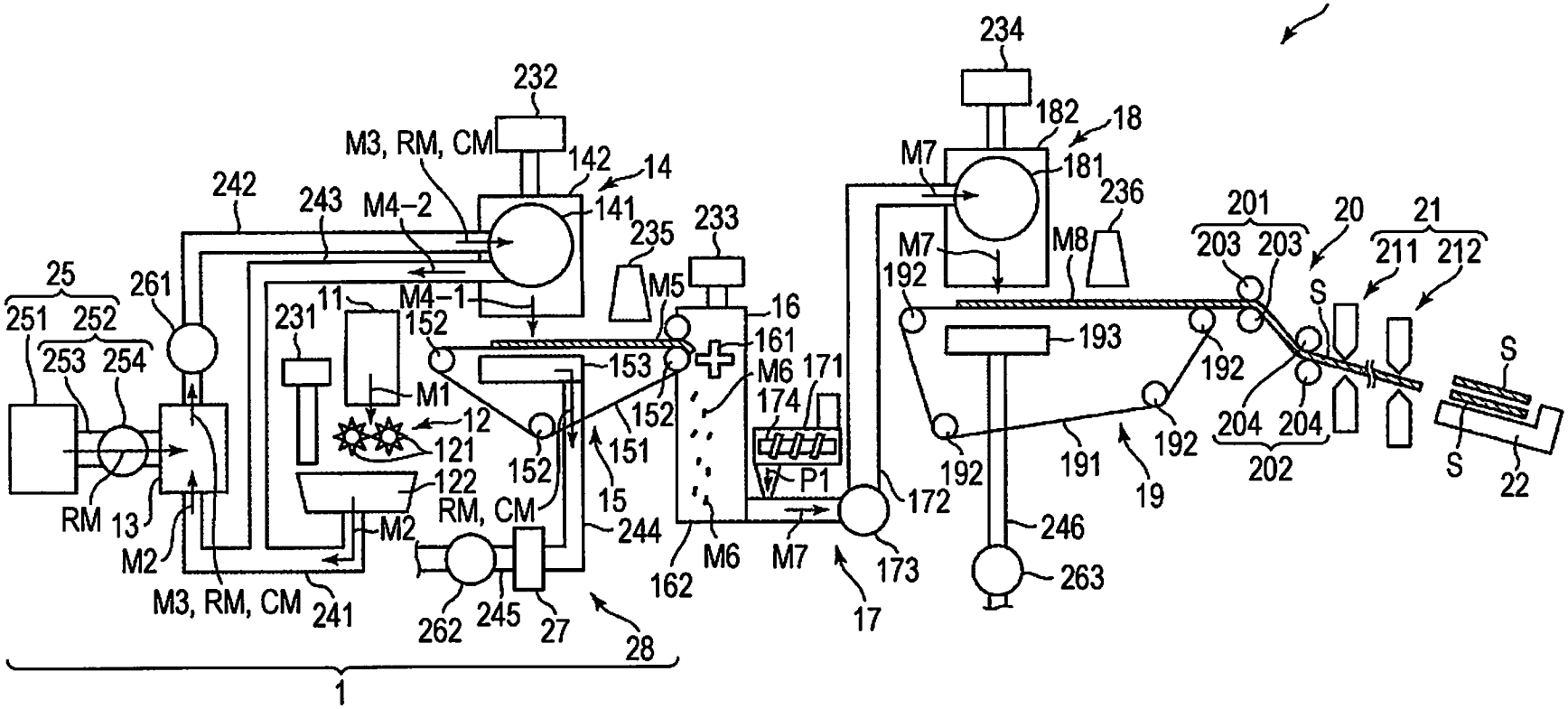
FIG. 1 is a schematic side view illustrating a first embodiment of a sheet manufacturing device (including a processing device according to an aspect of the invention) according to an aspect of the invention.

Hereinafter, a processing device, a sheet manufacturing device, a processing method, and a method for manufacturing a sheet according to an aspect of the invention are described in detail with reference to preferable embodiments illustrated in the accompanying drawings.

A processing device 1 according to an aspect of the invention contains a fibrillation portion 13 fibrillating fiber-containing materials containing fibers in the air (in the atmosphere), a particle supply portion 25 supplying particles RM having Mohs' hardness of 2 or more and 5 or less to fibrillated materials M3 (fiber-containing materials) during or after fibrillation for collision, and a particle removal portion 28 removing particles RM from the fibrillated materials M3 (fiber-containing materials) to which the particles RM are supplied.

A processing method according to an aspect of the invention includes a fibrillation process of fibrillating fiber-containing materials containing fibers in the air, a particle supply process of supplying particles RM having Mohs' hardness of 2 or more and 5 or less to fibrillated materials M3 (fiber-containing materials) during or after fibrillation for collision, and a particle removal process of removing the particles RM from the fibrillated materials M3 (fiber-containing materials) to which the particles RM are supplied. This method is performed by the processing device 1.

According to the invention described above, even when coloring materials CM are contained in the fibrillated materials M3, the coloring materials CM are removed from the fibrillated materials M3 by the particles RM supplied from the particle supply portion 25, and thereafter the coloring materials CM can also be removed together with the particles RM by the particle removal portion 28 as described later. Thus, the coloring materials CM can be quickly removed.

More specifically, the processing according to an aspect of the invention can be regarded as deinking processing of waste paper. Former deinking processing is generally processing including dispersing waste paper in water, mechanically/chemically (surfactants, alkali-based chemicals, and the like) separating a colorant, and then removing coloring materials by a flotation process, a screen cleaning method, and the like but the invention can achieve deinking without the necessity of immersing waste paper in water. The invention can be regarded as a dry deinking technique.

A sheet manufacturing device 100 according to an aspect of the invention has the processing device 1.

A processing method according to an aspect of the invention includes a fibrillation process of fibrillating fiber-containing materials containing fibers in the air, a particle supply process of supplying particles RM having Mohs' hardness of 2 or more and 5 or less to fibrillated materials M3 (fiber-containing materials) during or after fibrillation for collision, and a particle removal process of removing the particles RM from the fibrillated materials M3 (fiber-containing materials) to which the particles RM are supplied, in which a sheet is manufactured from the fibrillated materials M3 (fiber-containing materials) from which the particles RM are removed. This method is performed by the sheet manufacturing device 100.

According to the invention described above, a sheet S can be further manufactured (recycled) from a material from which the coloring materials CM are removed while enjoying the advantage of the processing device 1 (processing method) described above.

First Embodiment

Figure 2:
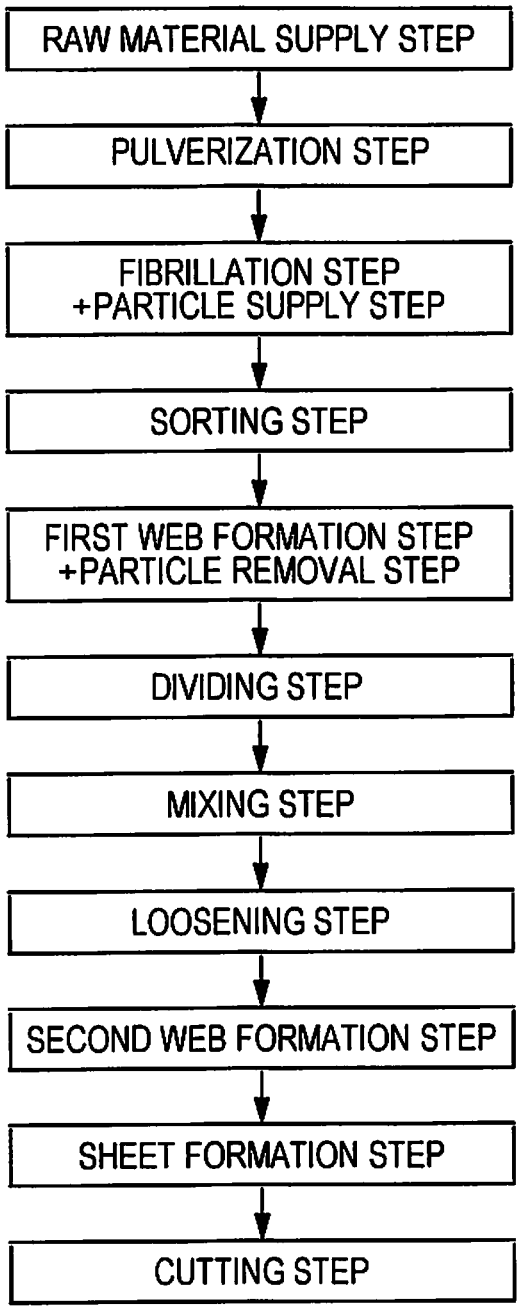
FIG. 2 is a view illustrating processes performed by the sheet manufacturing device illustrated in FIG. 1 in order.
Figure 3:
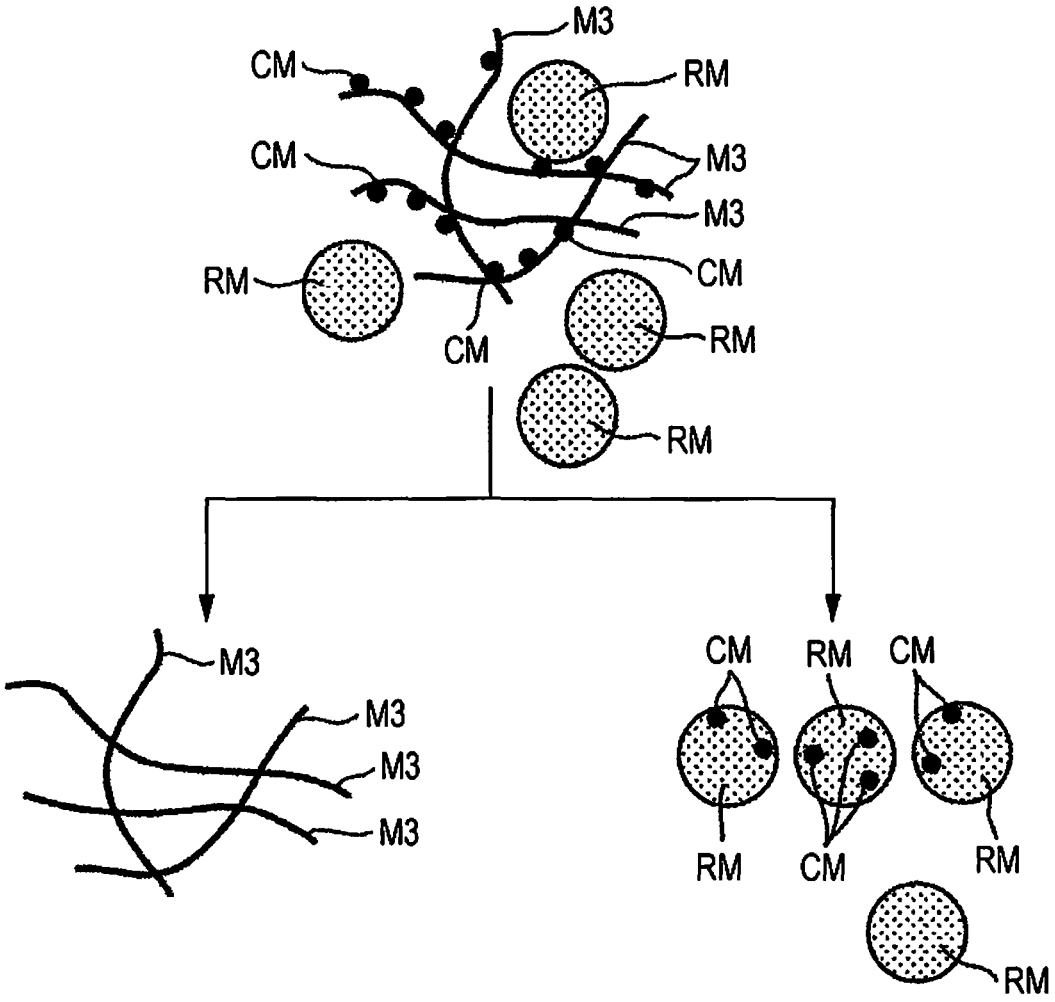
FIG. 3 is an image view illustrating a state where particles are supplied in the sheet manufacturing device illustrated in FIG. 1.
Figure 4:
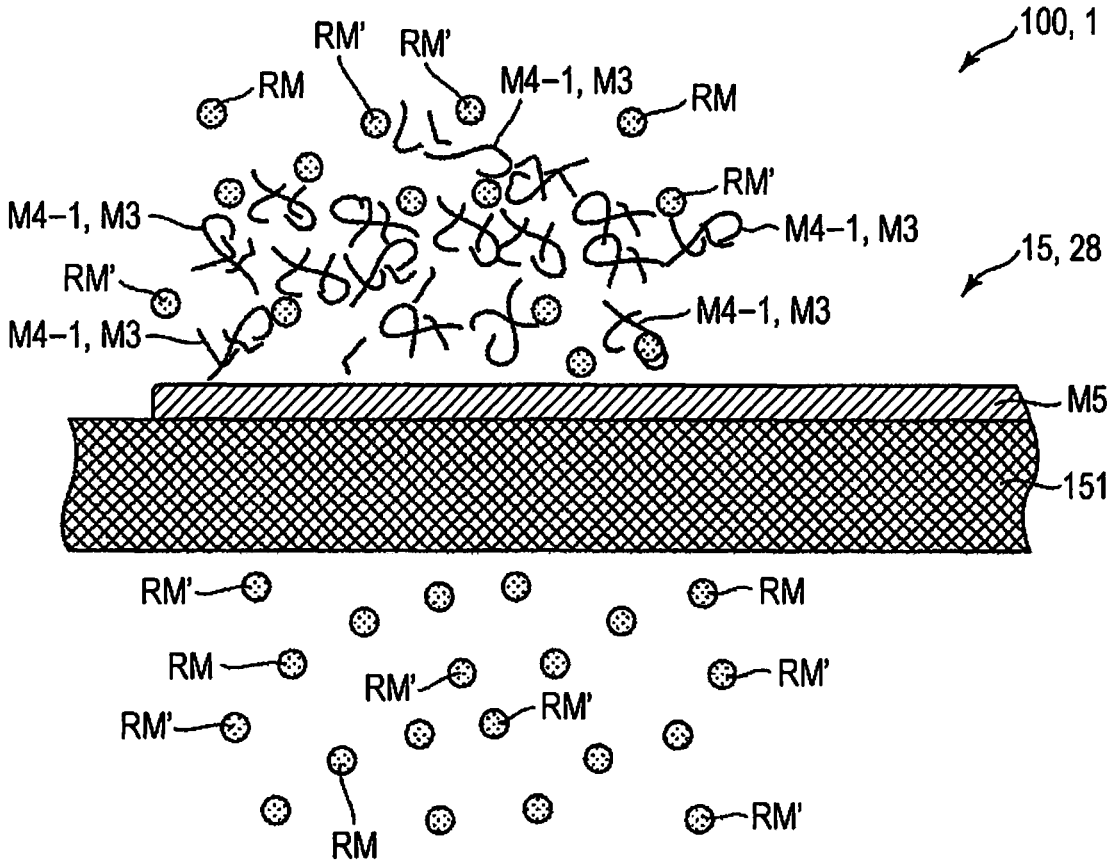
FIG. 4 is a schematic side view illustrating a state where the particles are removed in the sheet manufacturing device illustrated in FIG. 1.

FIG. 1 is a schematic side view illustrating a first embodiment of a sheet manufacturing device (including the processing device according to an aspect of the invention) according to an aspect of the invention. FIG. 2 is a view illustrating processes performed by the sheet manufacturing device illustrated in FIG. 1 in order. FIG. 3 is an image view illustrating a state where particles are supplied in the sheet manufacturing device illustrated in FIG. 1. FIG. 4 is a schematic side view illustrating a state where particles are removed in the sheet manufacturing device illustrated in FIG. 1. In the following description, the upper side in FIG. 1 and FIG. 4 (The same applies to FIG. 6 and FIG. 8.) is referred to as "top" or "above", the lower side is referred to as "bottom" or "under", the left side is referred to as "left" or "upstream side", and the right side is referred to as "right" or "downstream side" in some cases for convenience of description.

The sheet manufacturing device 100 illustrated in FIG. 1 has a raw material supply portion 11, a crushing portion 12, a fibrillation portion 13, a particle supply portion 25, a sorting portion 14, a first web formation portion 15, a fractionating portion 16, a mixing portion 17, a loosening portion 18, a second web formation portion 19, a sheet formation portion 20, a cutting portion 21, and a stock portion 22. Moreover, the sheet manufacturing device 100 has a humidification portion 231, a humidification portion 232, a humidification portion 233, and a humidification portion 234. The operation of each portion provided in the sheet manufacturing device 100 is controlled by a control portion (not illustrated).

Moreover, the sheet manufacturing device 100 has the processing device 1. In this embodiment, the processing device 1 contains the raw material supply portion 11, the crushing portion 12, the fibrillation portion 13, the particle supply portion 25, the sorting portion 14, and the first web formation portion 15.

As illustrated in FIG. 2, in this embodiment, a method for manufacturing a sheet has a raw material supply process (raw material supply step), a pulverization process (pulverization step), a fibrillation process (fibrillation step), a sorting process (sorting step), a first web formation process (first web formation step), a dividing process (dividing step), a mixing process (mixing step), a loosening process (loosening step), a second web formation process (second web formation step), a sheet formation process (sheet formation step), and a cutting process (cutting step). A particle supply process is performed with the fibrillation process and a particle removal process is performed with the first web formation process. The sheet manufacturing device 100 can perform these processes in order. Among the processes, the processes performed by the processing device 1 are the raw material supply process, the pulverization process, the fibrillation process, the particle supply process, the sorting process, the first web formation process, and the particle removal process.

Hereinafter, the configuration of each portion provided in the sheet manufacturing device 100 is described.

The raw material supply portion 11 is a portion performing the raw material supply process (refer to the raw material supply step in FIG. 2) of supplying a raw material M1 to the crushing portion 12. The raw material M1 is one containing fiber-containing materials containing fibers (cellulose fibers) and has a sheet shape for example. In this embodiment, the raw material M1 is waste paper, i.e., used sheet, but is not limited thereto and may be an unused sheet. The cellulose fiber may be one containing cellulose (cellulose in a narrow sense) as a compound as the main component and having a fiber shape and may be one containing hemicellulose and lignin other than the cellulose (cellulose in a narrow sense).

The crushing portion 12 is a portion performing the pulverization process (refer to the pulverization step in FIG. 2) of crushing the raw material M1 supplied from the raw material supply portion 11 in the air. The crushing portion 12 has a pair of crushing blades 121 and a chute (hopper) 122.

The pair of crushing blades 121 can crush, i.e., cut, the raw material M1 between the crushing blades 121 by rotating in directions opposite to each other to thereby form the raw material M1 into crushed pieces M2. The shape and the size of the crushed pieces M2 is preferably suitable for the fibrillation processing in the fibrillation portion 13 and, for example, small pieces having a one side length of 100 mm or less are preferable and small pieces having a one side length of 10 mm or more and 70 mm or less are more preferable.

The chute 122 is disposed under the pair of crushing blades 121 and has a funnel shape, for example. Thus, the chute 122 can receive the crushed pieces M2 crushed by the crushing blades 121 and dropping.

Above the chute 122, the humidification portion 231 is disposed adjacent to the pair of crushing blades 121. The humidification portion 231 humidifies the crushed pieces M2 in the chute 122. The humidification portion 231 contains a humidifier such as a vaporizing (or hot air vaporizing) humidifier having a filter (not illustrated) containing moisture and causing the air to pass through the filter to thereby supply humidified air with increased humidity to the crushed pieces M2. By the supply of the humidified air to the crushed pieces M2, the crushed pieces M2 can be prevented from adhering to the chute 122 and the like by static electricity.

The chute 122 is connected to the fibrillation portion 13 through a pipe (flow passage) 241. The crushed pieces M2 collected in the chute 122 pass through the pipe 241 to be transported to the fibrillation portion 13.

The fibrillation portion 13 is a portion performing the fibrillation process (refer to the fibrillation step in FIG. 2) of fibrillating the crushed pieces M2 (fiber containing materials containing a fiber) in the air, i.e., in a dry manner. By the fibrillation processing in this fibrillation portion 13, the fibrillated materials M3 can be generated from the crushed pieces M2. The "fibrillation" as used herein means disentangling the crushed pieces M2 formed by binding a plurality of fibers into one fiber. Then, the disentangled material is formed into the fibrillated material M3. The shapes of the fibrillated materials M3 are a line shape and a belt shape. The fibrillated materials M3 may be present in a state of being entangled to form an aggregate, i.e., a state of forming a so-called lump.

The fibrillation portion 13 contains an impeller mill having a rotor rotating at a high velocity and a liner located on the outer periphery of the rotor in this embodiment, for example. The crushed pieces M2 flowing into the fibrillation portion 13 are interposed between the rotor and the liner to be fibrillated.

The fibrillation portion 13 can generate the flow of the air (air current) from the crushing portion 12 toward the sorting portion 14 by the rotation of the rotor. Thus, the crushed pieces M2 can be sucked into the fibrillation portion 13 from the pipe 241. After the fibrillation treatment, the fibrillated materials M3 can be sent out to the sorting portion 14 through a pipe 242.

The fibrillation portion 13 also has a function of separating substances, such as resin particles, coloring materials, such as ink and toner, and a bleeding inhibitor, adhering to the fibrillated materials M3 (crushed pieces M2) from the fibers.

The particle supply portion (particle feeder) 25 is connected to the fibrillation portion 13 of such a configuration. The particle supply portion 25 is a portion of supplying particles RM having Mohs' hardness of 2 or more and 5 or less to the fibrillated materials M3 (fiber-containing materials) during fibrillation. The configuration of the particle supply portion 25 is described later.

Moreover, the fibrillation portion 13 is connected to the sorting portion 14 through the pipe (flow passage) 242. The fibrillated materials M3 (fiber-containing materials after fibrillation) pass through the pipe 242 to be transported to the sorting portion 14.

In the middle of the pipe 242, a blower 261 is disposed. The blower 261 is an air current generating device generating the air current toward the sorting portion 14. Thus, the sending out of the fibrillated materials M3 to the sorting portion 14 is promoted.

The sorting portion 14 is a portion performing the sorting process (refer to the sorting step in FIG. 2) of sorting the fibrillated materials M3 by the size of the fiber length. In the sorting portion 14, the fibrillated materials M3 are sorted into first sorted materials M4-1 and second sorted materials M4-2 larger than the first sorted materials M4-1. The first sorted materials M4-1 have a size suitable for the sequent manufacturing of the sheet S. The second sorted materials M4-2 include those which are not sufficiently fibrillated, those in which fibrillated fibers excessively aggregate, and the like, for example.

The sorting portion 14 has a drum portion 141 and a housing portion 142 housing the drum portion 141.

The drum portion 141 is a sieve containing a net body having a cylindrical shape and rotating around the central axis thereof. The fibrillated materials M3 flow into the drum portion 141. By the rotation of the drum portion 141, the fibrillated materials M3 smaller than the opening of the net are sorted as the first sorted materials M4-1 and the fibrillated materials M3 of a size larger than the opening of the net are sorted as the second sorted materials M4-2.

The first sorted materials M4-1 drop from the drum portion 141.

On the other hand, the second sorted materials M4-2 are sent out to a pipe (flow passage) 243 connected to the drum portion 141. In the pipe 243, the side opposite to the drum portion 141 (downstream side) is connected to the pipe 241. The second sorted materials M4-2 passing through the pipe 243 join the crushed pieces M2 within the pipe 241, and then flow into the fibrillation portion 13 with the crushed pieces M2. Thus, the second sorted materials M4-2 are returned to the fibrillation portion 13 to be subjected to fibrillation treatment with the crushed pieces M2.

The first sorted materials M4-1 from the drum portion 141 drop while dispersing in the air to move to the first web formation portion (separation portion) 15 located under the drum portion 141. The first web formation portion 15 is a portion performing the first web formation process (refer to the first web formation step in FIG. 2) of forming a first web M5 from the fibrillated materials M3. The first web formation portion 15 has a mesh belt (separation belt) 151, three stretching rollers 152, and a suction portion (suction mechanism) 153.

The mesh belt 151 is an endless belt and the first sorted materials M4-1 accumulate thereon. The mesh belt 151 is stretched by the three stretching rollers 152. Then, the first sorted materials M4-1 on the mesh belt 151 are transported to the downstream side by the rotational driving of the stretching roller 152.

The first sorted materials M4-1 have a size larger than the opening of the mesh belt 151. Thus, the passage of the fibrillated materials M3 through the mesh belt 151 is regulated, and thus the fibrillated materials M3 can accumulate on the mesh belt 151. Moreover, the first sorted materials M4-1 are transported to the downstream side together with the mesh belt 151 while accumulating on the mesh belt 151, and thus formed as the first web M5 of a layer shape.

The particles RM described later coexist in the fibrillated materials M3. The particles RM are smaller than the opening of the mesh belt 151. Thus, the particles RM pass through the mesh belt 151 to drop further downward.

The suction portion 153 can suck air from below the mesh belt 151. Thus, the particles RM passing through the mesh belt 151 can be sucked together with the air.

The suction portion 153 is connected to a collecting portion 27 through a pipe (flow passage) 244. The particles RM sucked by the suction portion 153 are collected in the collecting portion 27.

A pipe (flow passage) 245 is further connected to the collecting portion 27. In the middle of the pipe 245, a blower 262 is disposed. By the operation of the blower 262, the suction force can be generated in the suction portion 153. Thus, the formation of the first web M5 on the mesh belt 151 is promoted. The first web M5 is one from which the particles RM are removed. By the operation of the blower 262, the particles RM pass through the pipe 244 to reach the collecting portion 27.

The housing portion 142 is connected to the humidification portion 232. The humidification portion 232 contains the same vaporizing humidifier as that of the humidification portion 231. Thus, humidified air is supplied into the housing portion 142. By the humidified air, the first fibrillated materials M4-1 can be humidified and, therefore, the first fibrillated materials M4-1 can be prevented from adhering to the inner wall of the housing portion 142 by electrostatic force.

On the downstream side of the sorting portion 14, a humidification portion 235 is disposed. The humidification portion 235 contains a humidifier such as an ultrasonic humidifier spraying water. Thus, the moisture can be supplied to the first web M5, and, therefore, the moisture amount of the first web M5 is adjusted. By the adjustment, the adsorption of the first web M5 to the mesh belt 151 by electrostatic force can be prevented. Thus, the first web M5 is easily separated from the mesh belt 151 at a position where the mesh belt 151 is turned back by the stretching roller 152.

On the downstream side of the humidification portion 235, the fractionating portion 16 is disposed. The fractionating portion 16 is a portion performing the dividing process (refer to the dividing step FIG. 2) of dividing the first web M5 separated from the mesh belt 151. The fractionating portion 16 has a propeller 161 rotatably supported and a housing portion 162 housing the propeller 161. Then, the first web M5 is caught in the rotating propeller 161, whereby the first web M5 can be divided. The divided first webs M5 are formed into fractionated bodies M6. The fractionated bodies M6 descend in the housing portion 162.

The housing portion 162 is connected to the humidification portion 233. The humidification portion 233 contains the same vaporizing humidifier as that of the humidification portion 231. Thus, humidified air is supplied into the housing portion 162. By the humidified air, the fractionated bodies M6 can also be prevented from adhering to the propeller 161 or the inner wall of the housing portion 162 by electrostatic force.

On the downstream side of the fractionating portion 16, the mixing portion 17 is disposed. The mixing portion 17 is a portion performing the mixing process (refer to the mixing step in FIG. 2) of mixing the fractionated bodies M6 and a resin P1. The mixing portion 17 has a resin supply portion 171, a pipe (flow passage) 172, and a blower 173.

The pipe 172 is a flow passage which connects the housing portion 162 of the fractionating portion 16 and a housing portion of the loosening portion 18 and through which a mixture M7 of the fractionated bodies M6 and the resin P1 passes.

To the middle of the pipe 172, the resin supply portion 171 is connected. The resin supply portion 171 has a resin feeder such as a screw feeder 174. By the rotational driving of the screw feeder 174, the resin P1 can be supplied as powder or particles to the pipe 172. The resin P1 supplied to the pipe 172 is mixed with the fractionated bodies M6 to form a mixture M7.

The resin P1 binds the fibers in a subsequent process. For example, thermoplastic resins, curable resins, and the like are usable and the thermoplastic resins are preferably used. Examples of the thermoplastic resins include, for example, AS resin, ABS resin, polyolefins, such as polyethylene, polypropylene, and an ethylene-vinyl acetate copolymer (EVA), modified polyolefin, acrylic resin, such as polymethyl methacrylate, polyesters, such as polyvinyl chloride, polystyrene, polyethylene terephthalate, and polybutylene terephthalate, polyamides (nylon), such as Nylon 6, Nylon 46, Nylon 66, Nylon 610, Nylon 612, Nylon 11, Nylon 12, Nylon 6-12, and nylon 6-66, polyphenyleneether, polyacetal, polyether, polyphenylene oxide, polyetheretherketone, polycarbonate, polyphenylene sulfide, thermoplastic polyimide, polyether imide, a liquid crystal polymer, such as aromatic polyester, various thermoplastic elastomers, such as styrene-based elastomers, polyolefin-based elastomers, polyvinyl chloride-based elastomers, polyurethane-based elastomers, polyester-based elastomers, polyamide-based elastomers, polybutadiene-based elastomers, transpolyisoprene-based elastomers, fluororubber-based elastomers, and chlorinated polyethylene-based elastomers, and the like are mentioned, and one kind or two or more kinds selected from the substances can be used alone or in combination. Preferably, polyester or those containing polyester are preferably used as the thermoplastic resins.

Those supplied from the resin supply portion 171 may include, in addition to the resin P1, a colorant for coloring fibers, an aggregation inhibitor for inhibiting the aggregation of fibers or the aggregation of the resin P1, a flame retardant for making fibers inflammable, and the like, for example.

In the middle of the pipe 172, a blower 173 is disposed on the downstream side relative to the resin supply portion 171. The blower 173 can generate the air current toward the loosening portion 18. By the air current, the fractionated bodies M6 and the resin P1 can be stirred within the pipe 172. Thus, the mixture M7 can flow into the loosening portion 18 in a state where the fractionated bodies M6 and the resin P1 are uniformly dispersed. The fractionated bodies M6 in the mixture M7 are loosened during passing through the inside of the pipe 172 to be formed into a finer fiber shape.

The loosening portion 18 is a portion performing the loosening process (refer to the loosening step in FIG. 2) of loosening the fibers which are entangled with each other in the mixture M7. The loosening portion 18 has a drum portion 181 and a housing portion 182 housing the drum portion 181.

The drum portion 181 is a sieve containing a net body having a cylindrical shape and rotating around the central axis thereof. The mixture M7 flows into the drum portion 181. By the rotation of the drum portion 181, fibers smaller than the opening of the net of the mixture M7 and the like can pass through the drum portion 181. At that time, the mixture M7 is loosened.

The mixture M7 loosened in the drum portion 181 drops while dispersing in the air to move to the second web formation portion 19 located under the drum portion 181. The second web formation portion 19 is a portion performing the second web formation process (refer to the second web formation step in FIG. 2) of forming a second web M8 from the mixture M7. The second web formation portion 19 has a mesh belt (separation belt) 191, stretching rollers 192, and a suction portion (suction mechanism) 193.

The mesh belt 191 is an endless belt and the mixture M7 accumulates thereon. The mesh belt 191 is stretched by the four stretching rollers 192. The mixture M7 on the mesh belt 191 is transported to the downstream side by the rotational driving of the stretching roller 192.

Most of the mixtures M7 on the mesh belt 191 have a size larger than the opening of the mesh belt 191. Thus, the passage of the mixture M7 through the mesh belt 191 is regulated, and thus the mixture M7 can accumulate on the mesh belt 191. The mixture M7 is transported to the downstream side together with the mesh belt 191 while accumulating on the mesh belt 191, and thus formed as the second web M8 of a layer shape.

The suction portion 193 can suck air from below the mesh belt 191. Thus, the mixture M7 can be sucked onto the mesh belt 191, and, therefore, the accumulation of the mixture M7 on the mesh belt 191 is promoted.

A pipe (flow passage) 246 is connected to the suction portion 193. In the middle of the pipe 246, a blower 263 is disposed. By the operation of the blower 263, the suction force can be generated in the suction portion 193.

The housing portion 182 is connected to the humidification portion 234. The humidification portion 234 contains the same vaporizing humidifier as that of the humidification portion 231. Thus, humidified air is supplied into the housing portion 182. By the humidified air, the inside of the housing portion 182 can be humidified and, therefore, the mixture M7 can also be prevented from adhering to the inner wall of the housing portion 182 by electrostatic force.

On the downstream side of the loosening portion 18, a humidification portion 236 is disposed. The humidification portion 236 contains the same ultrasonic humidifier as that of the humidification portion 235. Thus, moisture can be supplied to the second web M8, and, therefore, the moisture amount of the second web M8 is adjusted. By the adjustment, the adsorption of the second web M8 to the mesh belt 191 by electrostatic force can be prevented. Thus, the second web M8 is easily separated from the mesh belt 191 at a position where the mesh belt 191 is turned back by the stretching roller 192.

On the downstream side of the second web formation portion 19, the sheet formation portion 20 is disposed. The sheet formation portion 20 is a portion that has at least one pair of rollers and performs the sheet formation process (refer to the sheet formation step in FIG. 2) of forming the sheet S from the second web M8. In the Embodiment, the sheet formation portion 20 has a pressurizing portion 201 and a heating portion 202.

The pressurizing portion 201 has a pair of calender rollers 203 and can pressurize the second web M8 without heating therebetween. Thus, the density of the second web M8 is increased. Then, the second web M8 is transported toward the heating portion 202. One of the pair of calender rollers 203 is a main drive roller driven by the operation of a motor (not illustrated) and the other one is a driven roller.

The heating portion 202 has a pair of heating rollers 204 and can pressurize the second web M8 while heating therebetween. By the pressurization under heating, the resin P1 melts, and then fibers are bound through the melted resin P1 in the second web M8. Thus, the sheet S is formed. Then, the sheet S is transported toward the cutting portion 21. One of the pair of heating rollers 204 is a main drive roller driven by the operation of a motor (not illustrated) and the other one is a driven roller.

On the downstream side of the sheet formation portion 20, the cutting portion 21 is disposed. The cutting portion 21 is a portion performing the cutting process (refer to the cutting step in FIG. 2) of cutting the sheet S. The cutting portion 21 has a first cutter 211 and a second cutter 212.

The first cutter 211 cuts the sheet S in a direction crossing the transportation direction of the sheet S.

The second cutter 212 cuts the sheet S in a direction parallel to the transportation direction of the sheet S on the downstream side of the first cutter 211.

By such cutting with the first cutter 211 and the second cutter 212, the sheet S of a desired size is obtained. Then, the sheet S is further transported to the downstream side to be accumulated in the stock portion 22.

As described above, the particle supply portion 25 is connected to the fibrillation portion 13 (refer to FIG. 1). The particle supply portion 25 is a portion performing the particle supply process (refer to the particle supply step in FIG. 2) of supplying the particles RM having Mohs' hardness of 2 or more and 5 or less to the fibrillated materials M3 (fiber-containing materials) during fibrillation in the fibrillation portion 13. In this embodiment, the fibrillated materials M3 are also subjected to the particle supply process while being subjected to the fibrillation process in the air.

FIG. 1 illustrates a view in which the particle supply portion 25 is connected to the center of the fibrillation portion 13 but the configuration is not necessarily limited to the configuration because the particles RM may be able to be supplied to the fibrillation portion 13. For example, the particle supply portion 25 may be configured so as to be connected to the pipe 241 on the upstream side of the fibrillation portion 13 to transport the particles RM to the fibrillation portion 13 with the crushed pieces M2 transported from the chute 122.

In this embodiment, the raw material M1 is waste paper which has been printed and has been already used. Therefore, as illustrated in FIG. 3, the fibrillated materials M3 (fiber-containing materials) are those containing the coloring materials CM, i.e., those to which the coloring materials CM adhere. Examples of the coloring materials CM include a black or colored toner, various kinds of ink, various kinds of dyes, pigments, and the like, for example.

The particles RM supplied to the fibrillation portion 13 from the particle supply portion 25 have a function of adsorbing the coloring materials CM contained in the fibrillated materials M3 (fiber-containing materials) from the fibrillated materials M3 (fiber). Then, due to the fact that the particles RM demonstrate the adsorption function, the coloring materials CM shift to the particles RM to be certainly removed from the fibrillated materials M3 as illustrated in FIG. 3. Thus, the particles RM are removing particles for removing the coloring materials CM from the fibrillated materials M3. In particular, the coloring material CM is preferably toner because the particles RM have a high function as removing particles.

The particle supply portion 25 has a storage portion 251. The storage portion 251 is a tank storing the particles RM. The storage portion 251 is exchanged for a new one in which the particles RM are sufficiently stored when the storage portion 251 has become empty.

The particle supply portion 25 has an ejection portion (particle ejector) 252 connected to (or disposed in) the fibrillation portion 13 between the particle supply portion 25 and the storage portions 251 and ejecting the particles RM to the fibrillated materials M3 (fiber-containing materials) in the fibrillation portion 13. The ejection portion 252 contains a pipe 253 and a blower 254. The particle supply portion 25 may be disposed in the fibrillation portion 13 or may be integrally disposed with the fibrillation portion 13.

The pipe 253 connects the storage portion 251 and the fibrillation portion 13. The particles RM can pass through the inside of the pipe 253 from the storage portion 251 toward the fibrillation portion 13.

In the middle in the longitudinal direction of the pipe 253, the blower 254 is disposed. The blower 254 can generate the air current toward the fibrillation portion 13. Thus, the particles RM are ejected into the fibrillation portion 13 passing through the inside of the pipe 253. Some of the ejected particles RM collide with the coloring materials CM adhering to the fibrillated materials M3 for contacting. The particles RM can adsorb the coloring materials CM to cause the coloring materials CM to shift from the fibrillated materials M3. Thus, the coloring materials CM can be certainly removed from the fibrillated materials M3.

By the ejection of the particles RM, the fibrillated materials M3 (fiber-containing materials) contact the particles RM while being stirred. Thus, the contact between the coloring materials CM adhering to the fibrillated materials M3 and the particles RM is also promoted, and, therefore, the coloring materials CM can be sufficiently removed from the fibrillated materials M3.

As the particles RM suitable for the removal of the coloring materials CM, those having Mohs' hardness of 2 or more and 5 or less are usable and those having Mohs' hardness of 2 or more and 4 or less are preferably used. Thus, the coloring material CM adsorption/removal ability is effectively demonstrated. When the Mohs' hardness of the particles RM is less than the lower limit mentioned above, the coloring material CM adsorption/removal ability to/from the fibrillated materials M3 is insufficient depending on conditions, such as the type, amount, and the like of the coloring materials CM, for example, in some cases. When the Mohs' hardness of the coloring materials CM exceeds the upper limit mentioned above, there is a possibility that the damages in the collision are given to the fibrillated materials M3, for example. Such particles RM are not particularly limited and, for example, the following substances are mentioned.

The particles RM preferably contain a resin-based material, for example. The resin-based material is not particularly limited and, for example, various thermoplastic resins and various thermosetting resins are mentioned.

Examples of the thermoplastic resins include, for example, polyolefins, such as polyethylene, polypropylene, and an ethylene vinyl acetate copolymer, modified polyolefin, polyamides (e.g., Nylon 6, Nylon 46, Nylon 66, Nylon 610, Nylon 612, Nylon 11, Nylon 12, Nylon 6-12, and Nylon 6-66), thermoplastic polyimide, a liquid crystal polymer, such as aromatic polyester, polyphenylene oxide, polyphenylene sulfide, polycarbonate, polymethyl methacrylate, polyether, polyetheretherketone, polyetherimide, polyacetal, thermoplastic elastomers, such as styrene-based elastomers, polyolefin-based elastomers, polyvinyl chloride-based elastomers, polyurethane-based elastomers, polyester-based elastomers, polyamide-based elastomers, polybutadiene-based elastomers, transpolyisoprene-based elastomers, fluororubber-based elastomers, and chlorinated polyethylene-based elastomers, or a copolymer, a blended body, and a polymer alloy containing the same as the main component, and these substances can be used alone or as a mixture of two or more kinds thereof. Among the above, polyamide and polycarbonate are particularly preferably used.

Examples of the thermosetting resins include, for example, epoxy resin, phenol resin, urea resin, melamine resin, polyester (unsaturated polyester) resin, polyimide resin, silicone resin, polyurethane resin, and the like and the resins can be used alone or as a mixture of two or more kinds thereof. Among the above, the urea resin and the melamine resin are particularly preferably used.

By the use of such resin-based materials, the particles RM can sufficiently demonstrate the function (coloring material CM adsorption/removal ability) as the removing particles described above. Even when the particles RM collide with the fibrillated materials M3, the fibrillated materials M3 can be prevented from being damaged by the collision. Even when the particles RM stay in a process on the downstream side relative to the particle supply process, a deterioration of the quality of the sheet S to be manufactured can be prevented.

When the particles RM contain the resin-based materials, the average particle diameter of the particle RM is preferably within the range of 150 μm or more and 1500 μm or less and more preferably within the range of 180 μm or more and 1200 μm or less. Moreover, those having high coloring material CM adsorption/removal ability are preferable.

As the particles RM, those containing plant-based materials are preferable other than the resin-based materials, for example. The plant-based materials are not particularly limited, and, for example, those obtained by grinding the husk of seeds of plants and those obtaining grinding the husk of fruits of plants are mentioned.

As the seeds of plants, seeds of walnut, peach, and apricot, and the like are usable, for example.

As the fruits of plants, kernels of dried corn, an albumen of dried wheat, and the like are usable.

By the use of such plant-based materials, the particles RM can sufficiently demonstrate the function (coloring material CM adsorption/removal ability) as the removing particles described above as with the resin-based materials. Even when the particles RM collide with the fibrillated materials M3, the fibrillated materials M3 can be prevented from being damaged by the collision.

When the particles RM contain the plant-based materials, the average particle diameter of the particles RM is preferably within the range of 60 μm or more and 5500 μm or less and more preferably within the range of 100 μm or more and 5000 μm or less. Moreover, those having high coloring material CM adsorption/removal ability are preferable.

The particle RM may be a porous body or may have minute irregularities, for example.

The speed (ejection rate) of the particles RM ejected into the fibrillation portion 13 is set as appropriate by the configuration material and the particle diameter of the particles RM, for example.

As illustrated in FIG. 1, the sheet manufacturing device 100 (processing device 1) has the particle removal portion (particle remover) 28. The particle removal portion 28 is a portion performing the particle removal process (refer to the particle removal step in FIG. 2) of removing the particles RM together with the coloring materials CM from the fibrillated materials M3 (fiber-containing materials) to which the particles RM are supplied. In this embodiment, the fibrillated materials M3 are also subjected to the particle removal process while being subjected to the first web formation process.

In the configuration illustrated in FIG. 1, the particle removal portion 28 contains the first web formation portion 15, the collecting portion 27, the pipe 244, the pipe 245, and the blower 262.

Above the first web formation portion 15, the fibrillated materials M3 are sorted into the first sorted materials M4-1 and the second sorted materials M4-2 by the sorting portion 14 as described above. As illustrated in FIG. 4, in the first sorted materials M4-1, the particles RM adsorbing the coloring materials CM (hereinafter the particles RM are sometimes referred to as "particles RM'") coexist. The first sorted materials M4-1 may contain particles RM not adsorbing the coloring materials CM. Then, the first sorted materials M4-1 drop on the mesh belt 151 of the first web formation portion 15 with the particles RM'.

The particle removal portion 28 separates and removes the particles RM utilizing a difference in the size (particle diameter) between the fibrillated materials M3 (fiber) and the particles RM. More specifically, the particle removal portion 28 has the mesh belt 151 (net-like body) having an opening of a size which allows the passage of the particles RM (particles RM') but regulates the passage of the fibers of the first sorted materials M4-1 (the fibrillated materials M3). Thus, as illustrated in FIG. 4, the first sorted materials M4-1 accumulate on the mesh belt 151 to be formed as the first web M5. On the other hand, the particles RM (particles RM') pass through the mesh belt 151 by the suction force in the suction portion 153, and then collected in the collecting portion 27 via the suction portion 153 and the pipe 244 in order. Thus, the first web M5 is formed into one from which the particles RM (particles RM') are removed. Then, the first web M5 is transported to the subsequent processes to be finally formed into the sheet S. The particles RM collected in the collecting portion 27 contain the particles RM adsorbing the coloring materials CM, i.e., particles RM', and the particles RM not adsorbing the coloring materials CM.

As described above, in the sheet manufacturing device 100 (processing device 1), even when the coloring materials CM are contained in the waste paper which is the raw material M1 for sheet recycling, the coloring materials CM are removed by the particles RM supplied from the particle supply portion 25, and thereafter the particle removal portion 28 can remove the coloring materials CM together with particles RM. Thus, the sheet S to be manufactured is formed into a high quality sheet from which the coloring materials CM which may serve as impurities in recycling are removed.

Second Embodiment

Figure 5:
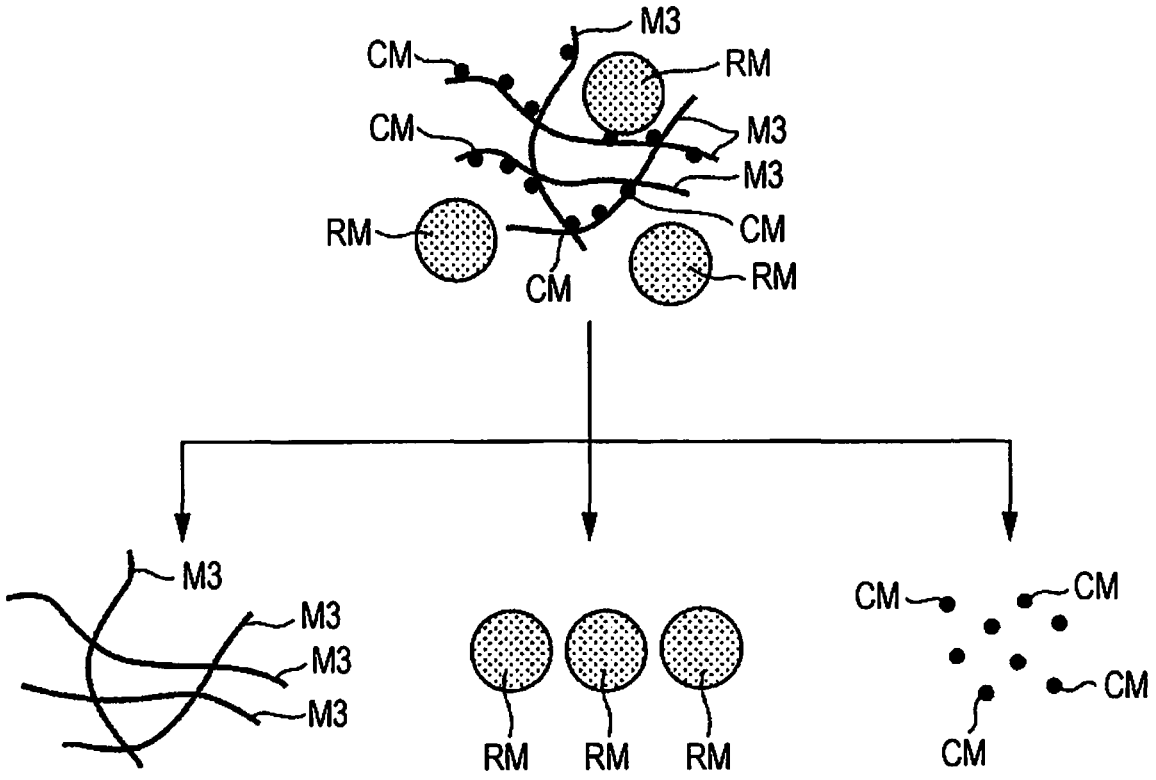
FIG. 5 is an image view illustrating a state where particles are supplied in a second embodiment of the sheet manufacturing device (including the processing device according to an aspect of the invention) according to an aspect of the invention.

FIG. 5 is an image view illustrating a state where particles are supplied in a second embodiment of the sheet manufacturing device (including the processing device according to an aspect of the invention) according to an aspect of the invention.

Hereinafter, the second embodiment of the processing device, the sheet manufacturing device, the processing method, and the method for manufacturing a sheet according to an aspect of the invention is described with reference to the figure but is described focusing on differences from the embodiment described above and a description of the same matter is omitted.

This embodiment is the same as the first embodiment except a difference in a function of the particles supplied from the particle supply portion.

As illustrated in FIG. 5, the fibrillated materials M3 (fiber-containing materials) are those containing the coloring materials CM, i.e., those to which the coloring materials CM adhere.

The particles RM are ejected and supplied to the fibrillation portion 13 from the particle supply portion 25. The particles RM have a function of colliding with the coloring materials CM contained in the fibrillated materials M3 (fiber-containing materials) to separate and remove the coloring materials CM from the fibrillated materials M3 (fiber) depending on the ejection rate and the size of the particle diameter. Thus, the coloring materials CM are certainly removed from the fibrillated materials M3 as illustrated in FIG. 5. The particles RM are separated also from the coloring materials CM in FIG. 5 but the particles RM adsorbing the coloring materials CM, i.e., particles RM', may be contained as with the first embodiment.

Third Embodiment

Figure 6:
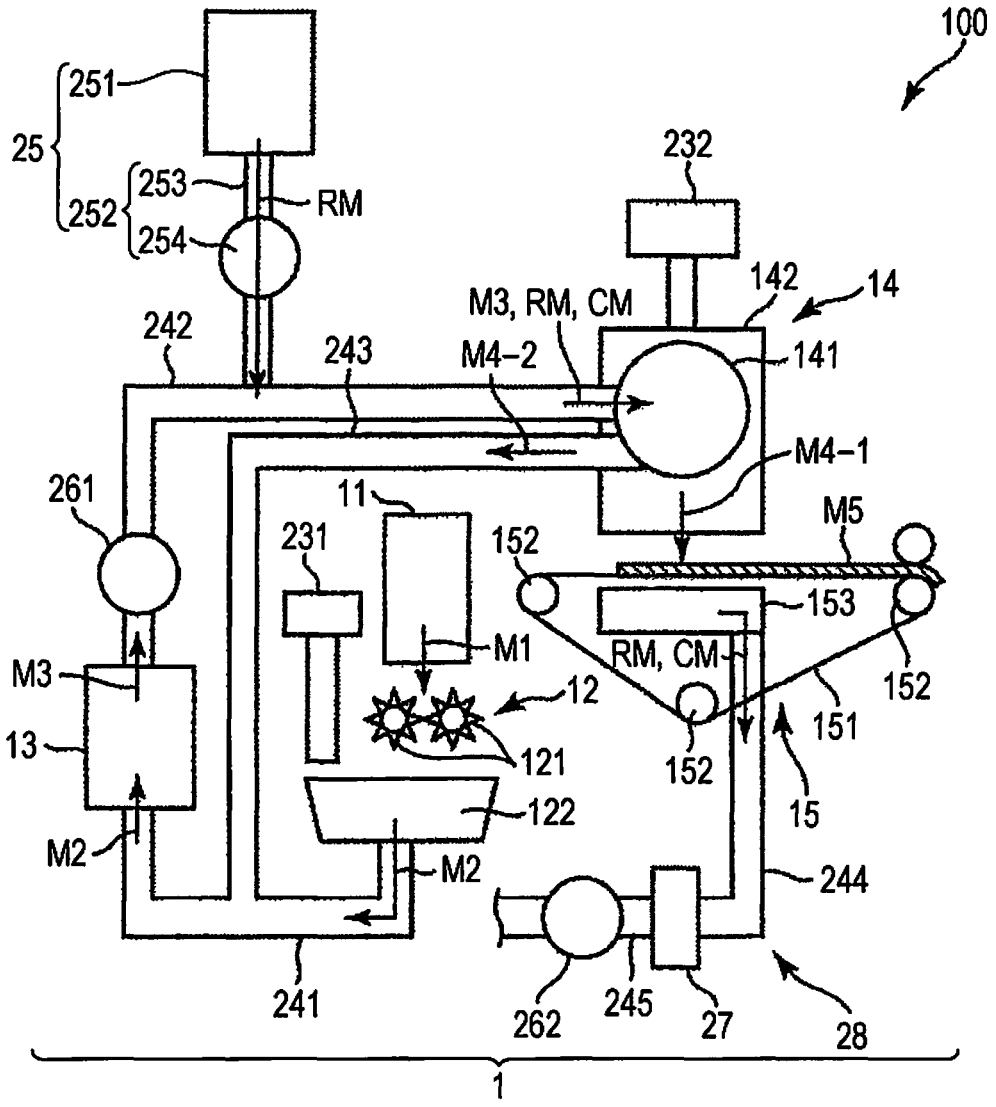
FIG. 6 is a schematic side view illustrating the upstream side of a third embodiment of the sheet manufacturing device (including the processing device according to an aspect of the invention) according to an aspect of the invention.
Figure 7:
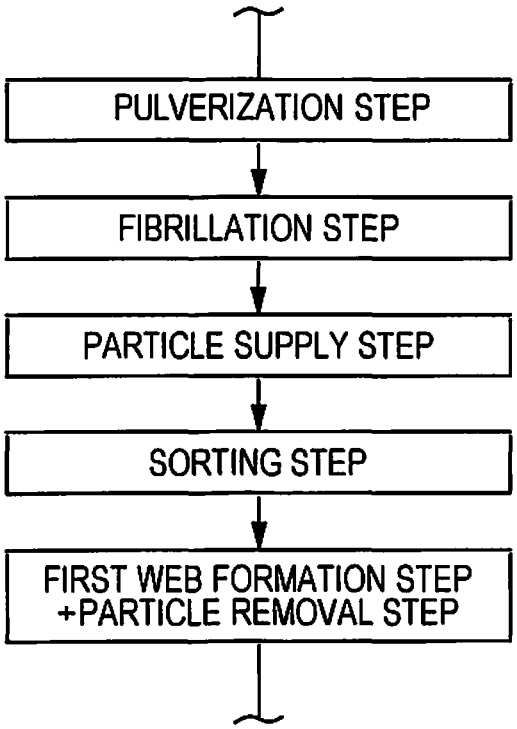
FIG. 7 is a view illustrating processes performed by the sheet manufacturing device illustrated in FIG. 6 in order.

FIG. 6 is a schematic side view illustrating the upstream side of a third embodiment of the sheet manufacturing device (including the processing device according to an aspect of the invention) according to an aspect of the invention. FIG. 7 is a view illustrating processes performed by the sheet manufacturing device illustrated in FIG. 6 in order.

Hereinafter, the third embodiment of the processing device, the sheet manufacturing device, the processing method, and the method for manufacturing a sheet according to an aspect of the invention is described with reference to the figures but is described focusing on differences from the embodiment described above and a description of the same matter is omitted.

This embodiment is the same as the first embodiment except in a difference in the arrangement place of the particle supply portion and the timing of performing the particle supply process in connection with the difference.

As illustrated in FIG. 6, the sheet manufacturing device 100 (processing device 1) has the pipe (flow passage) 242 which is connected to the fibrillation portion 13 and through which the fibrillated materials M3 (fiber-containing materials after fibrillation) pass.

In this embodiment, the particle supply portion 25 performs the particle supply process (refer to the particle supply step in FIG. 7) of supplying particles RM having Mohs' hardness of 2 or more and 5 or less after the fibrillation process, i.e., to the fibrillated materials M3 (fiber-containing materials after fibrillation). The particle supply portion 25 has the ejection portion 252 connected to the downstream side relative to the blower 261 of the pipe (flow passage) 242 and ejecting the particles RM to the pipe (flow passage) 242. Thus, the particles RM can be supplied to the fibrillated materials M3 which have been sufficiently fibrillated. By such supply, the particles RM spread to every portion of the fibrillated materials M3 and, as a result, collide also with the coloring materials CM for contacting. Thus, the particles RM are sufficiently adsorbed to the coloring materials CM, so that the coloring materials CM can be more certainly removed from the fibrillated materials M3.

Fourth Embodiment

Figure 8:
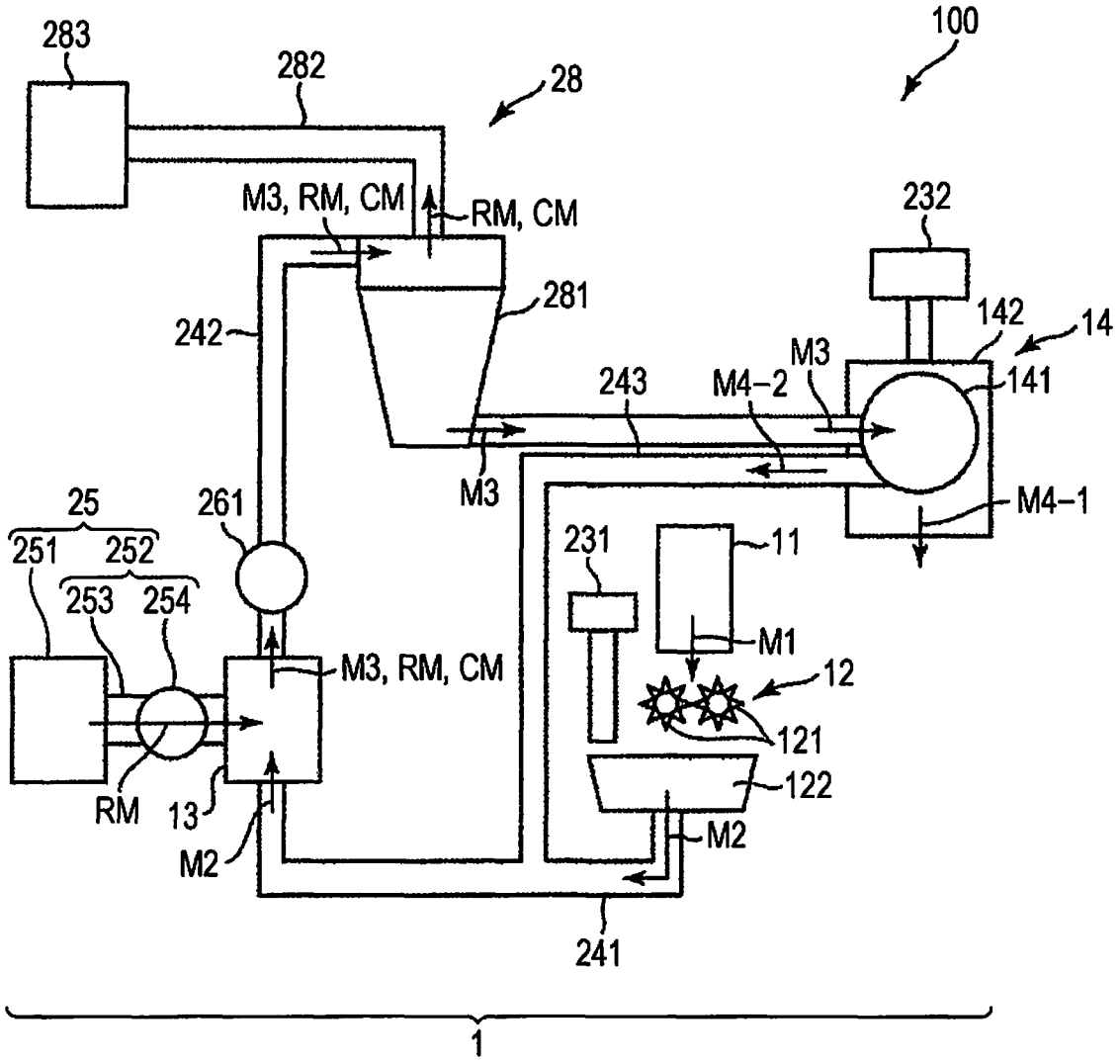
FIG. 8 is a schematic side view illustrating the upstream side of a fourth embodiment of the sheet manufacturing device (including the processing device according to an aspect of the invention) according to an aspect of the invention.
Figure 9:
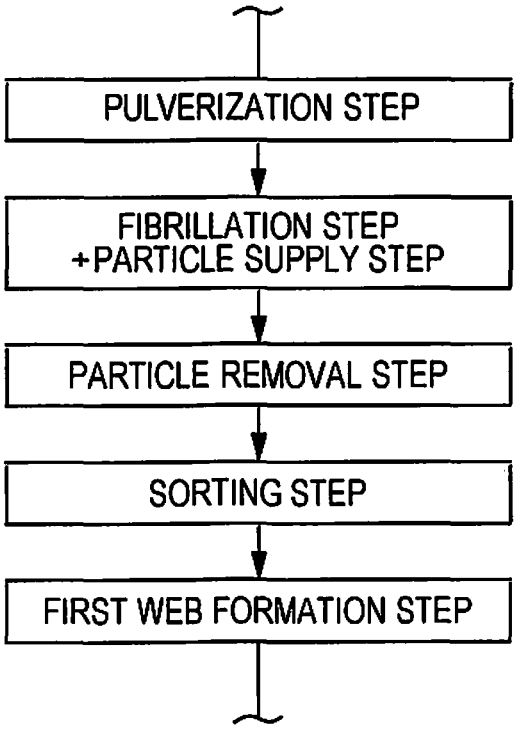
FIG. 9 is a view illustrating processes performed by the sheet manufacturing device illustrated in FIG. 8 in order.

FIG. 8 is a schematic side view illustrating the upstream side of a fourth embodiment of the sheet manufacturing device (including the processing device according to an aspect of the invention) according to an aspect of the invention. FIG. 9 is a view illustrating processes performed by the sheet manufacturing device illustrated in FIG. 8 in order.

Hereinafter, the fourth embodiment of the processing device, the sheet manufacturing device, the processing method, and the method for manufacturing a sheet according to an aspect of the invention is described with reference to the figures but is described focusing on differences from the embodiment described above and a description of the same matter is omitted.

This embodiment is the same as the first embodiment except a difference in the arrangement place of the particle removal portion and the configuration of the particle removal portion.

As illustrated in FIG. 8, in this embodiment, the particle removal portion 28 is disposed in the middle of the pipe 242 and on the downstream side relative to the blower 261. Thus, the particle removal process in the particle removal portion 28 is performed after the fibrillation process (refer to the fibrillation step in FIG. 9).

The particle removal portion 28 separates and removes the particles RM (particles RM') from the fibrillated materials M3 (fiber-containing materials) utilizing a specific gravity difference. More specifically, the particle removal portion 28 is configured so as to remove the particles RM (particles RM') by centrifugal separation and has a centrifugal separation portion (centrifugal separator) 281, a pipe 282, and a collecting portion 283. The centrifugal separation portion 281 and the collecting portion 283 are connected through the pipe 282.

The centrifugal separation portion 281 is disposed in and connected to the middle of the pipe 242, and performs centrifugal separation to separate the fibrillated materials M3 and the particles RM (particles RM'). The fibrillated materials M3 and the particles RM (particles RM') passing through the pipe 242 collectively flow into the centrifugal separation portion 281. The particles RM flowing into the centrifugal separation portion 281 contain the particles RM to which the coloring materials CM are adsorbed, i.e., particles RM', and the particles RM to which the coloring materials are not adsorbed. Then, the fibrillated materials M3 and the particles RM (particles RM') are divided into the fibrillated materials M3 further flowing down toward the sorting portion 14 through the pipe 242 and the particles RM (particles RM') moving toward the pipe 282 by the centrifugal separation in the centrifugal separation portion 281. The particles RM (particles RM') moving toward the pipe 282 pass through the pipe 282 with the coloring materials CM to be collected in the collecting portion 283.

The coloring materials CM can be certainly removed from the fibrillated materials M3 together with the particles RM also by such a particle removal portion 28.

Fifth Embodiment

Figure 10:
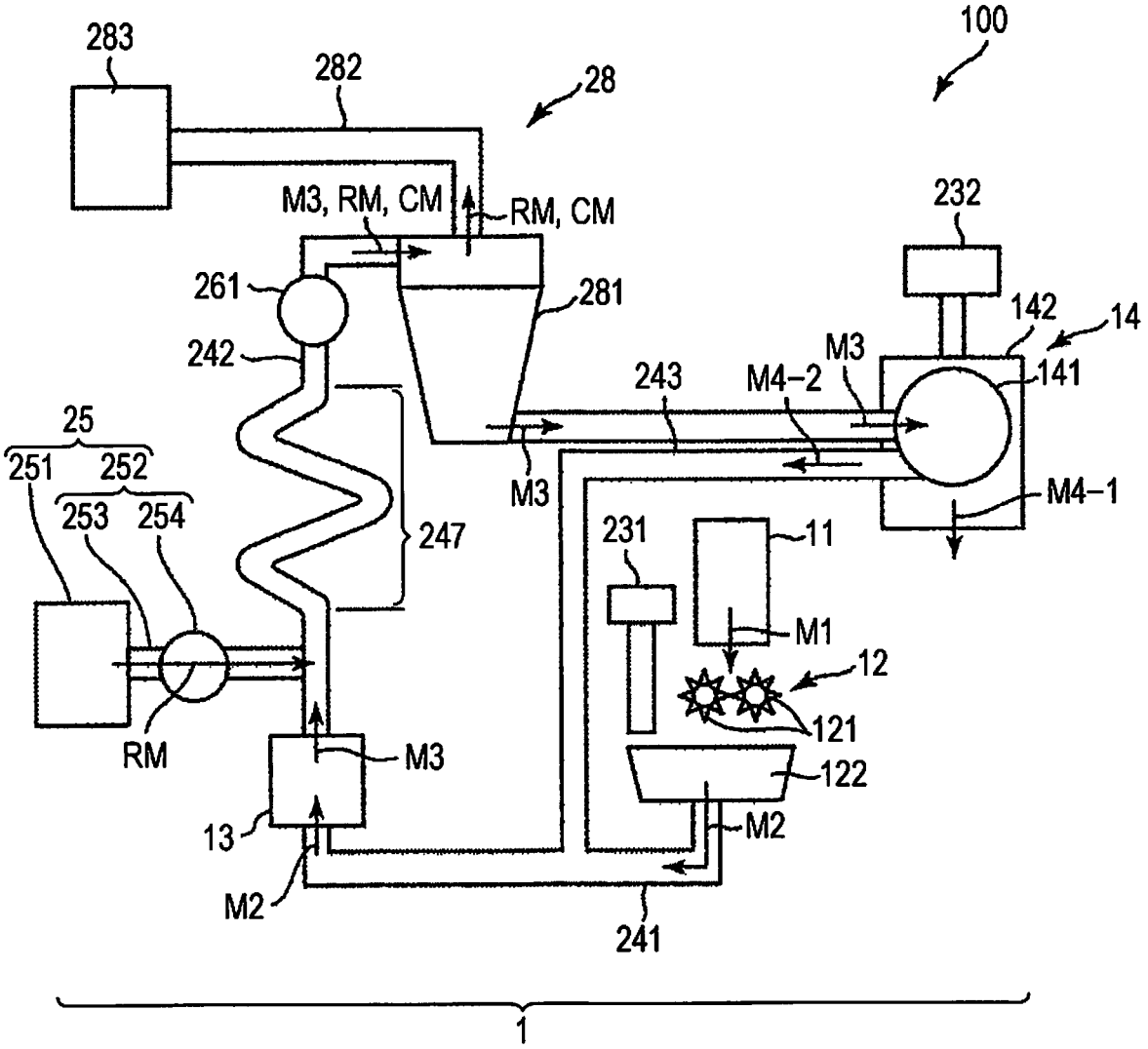
FIG. 10 is a schematic side view illustrating the upstream side of a fifth embodiment of the sheet manufacturing device (including the processing device according to an aspect of the invention) according to an aspect of the invention.
Figure 11:
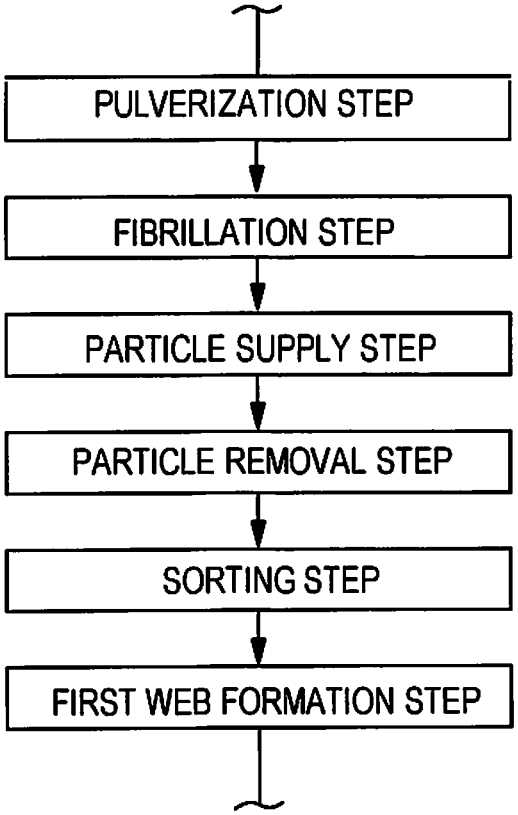
FIG. 11 is a view illustrating processes performed by the sheet manufacturing device illustrated in FIG. 10 in order.

FIG. 10 is a schematic side view illustrating the upstream side of a fifth embodiment of the sheet manufacturing device (including the processing device according to an aspect of the invention) according to an aspect of the invention. FIG. 11 is a view illustrating processes performed by the sheet manufacturing device illustrated in FIG. 10 in order.

Hereinafter, the fifth embodiment of the processing device, the sheet manufacturing device, the processing method, and the method for manufacturing a sheet according to an aspect of the invention is described with reference to the figures but is described focusing on differences from the embodiment described above and a description of the same matter is omitted.

This embodiment is the same as the fourth embodiment except a difference in the arrangement place of the particle supply portion.

As illustrated in FIG. 10, the particle supply portion 25 is disposed in and connected to the middle of the pipe 242 and the upstream side relative to the particle removal portion 28 in this embodiment. Thus, the particle supply process in the particle supply portion 25 is performed after the fibrillation process, and the particle removal process is further performed after the particle supply process (refer to the particle supply step in FIG. 11). The arrangement place of the particle supply portion 25 is the upstream side relative to the particle removal portion 28 but is preferably the upstream side relative to the blower 261.

Moreover, in the pipe 242, a meandering portion 247 which meanders is formed between a portion in which the particle supply portion 25 is connected and the blower 261. Thus, when the particles RM pass through the meandering portion 247, an opportunity to collide with the coloring materials CM increases, and, therefore, the adsorption of the coloring materials CM is promoted.

Furthermore, the speed of passing through the pipe 242 of the particles RM is increased by the action of the blower 261. Thus, the opportunity for the particles RM and the fibrillated materials M3 to collide with each other increases, and, as a result, the particles RM also contact the coloring materials CM adhering to the fibrillated materials M3, so that the adsorption of the coloring materials CM is promoted.

Then, the particles RM (particles RM') adsorbing the coloring materials CM are removed in the particle removal portion 28.

As described above, the processing device, the sheet manufacturing device, the processing method, and the method for manufacturing a sheet according to an aspect of the invention are described according to the embodiments illustrated in the figures but the invention is not limited thereto. Moreover, each portion configuring the processing device and the sheet manufacturing device can be replaced by those having arbitrary configurations capable of demonstrating the same functions. Moreover, arbitrary structures may be added.

Moreover, the processing device, the sheet manufacturing device, the processing method, and the method for manufacturing a sheet according to an aspect of the invention may be those containing a combination of two or more arbitrary configurations (features) in the embodiments described above.

Moreover, the particles for use in the removal of the coloring materials may be those containing a combination of resin-based materials and plant-based materials.

A processing device according to an aspect of an embodiment contains a fibrillation portion fibrillating fiber-containing materials containing fibers in the air, a particle supply portion supplying particles having Mohs' hardness of 2 or more and 5 or less to the fiber-containing materials during or after fibrillation for collision, and a particle removal portion removing the particles from the fiber-containing materials to which the particles are supplied.

Thus, even when the coloring materials are contained in the fiber-containing materials, the coloring materials are removed from the fiber-containing materials by the particles supplied from the particle supply portion, and thereafter the coloring materials can also be removed together with the particles by the particle removal portion. Thus, the coloring material can be quickly removed.

It is preferable in the processing device according to the aspect of the embodiment that the fiber-containing materials contain coloring materials and the particles have a function of adsorbing the coloring materials contained in the fiber-containing materials from the fibers.

Thus, the coloring materials shift to the particles by the adsorption to be removed from the fibers.

It is preferable in the processing device according to the aspect of the invention that the fiber-containing materials contain coloring materials and the particles have a function of colliding with the coloring materials contained in the fiber-containing materials to separate the coloring materials from the fibers.

Thus, the coloring materials are separated to be removed from the fiber by the collision of the particles.

It is preferable in the processing device according to the aspect of the embodiment that the particles contain a resin-based material.

Thus, the particles can sufficiently demonstrate the function as removing particles for removing the coloring materials from the fibers. Moreover, even when the particles collide with the fibers, the fibers can be prevented from being damaged by the collision.

It is preferable in the processing device according to the aspect of the embodiment that the particles contain a plant-based material.

Thus, the particles can sufficiently demonstrate the function as removing particles for removing the coloring materials from the fibers. Moreover, even when the particles collide with the fibers, the fibers can be prevented from being damaged by the collision.

It is preferable in the processing device according to the aspect of the embodiment that the particle supply portion has an ejection portion connected to or disposed in the fibrillation portion and ejecting the particles to the fiber-containing materials in the fibrillation portion.

Some of the ejected particles collide with the coloring materials adhering to the fibers for contacting. Then, the particles can adsorb the coloring materials to cause the coloring materials to shift from the fibers, for example. Thus, the coloring materials can be certainly removed from the fibers.

It is preferable for the processing device according to the aspect of the embodiment that a flow passage which is connected to the fibrillation portion and through which the fiber-containing materials after fibrillation pass is provided and the particle supply portion has an ejection portion connected to the flow passage and ejecting the particles to the flow passage.

Thus, the particles can be supplied to the fiber-containing materials which have been sufficiently fibrillated. By such supply, the particles spread to every portion of the fibrillated fiber-containing materials, and, as a result, collide also with the coloring materials for contacting. Thus, the coloring materials can be certainly removed from the fiber-containing materials.

It is preferable in the processing device according to the aspect of the embodiment that the fiber-containing materials contact the particles while being stirred by the ejection of the particles.

Thus, the contact (collision) with the particles and the coloring materials adhering to the fibers is also promoted, and therefore the coloring materials can be sufficiently removed from the fibers.

It is preferable in the processing device according to the aspect of the embodiment that the particle removal portion has a net-like body having an opening of a size which allows the passage of the particles but regulates the passage of the fibers.

Thus, the fibers accumulate on the net-like body to be formed into a web, for example. On the other hand, the particles pass through the net-like body. Therefore, the web formed on the net-like body by the accumulation is one from which the particles are removed.

It is preferable in the processing device according to the aspect of the embodiment that the particle removal portion is configured so as to remove the particles by centrifugal separation.

Thus, the coloring materials can be certainly removed from the fiber-containing materials together with the particles.

A sheet manufacturing device according to an aspect of the embodiment has the processing device according to the aspect of the embodiment.

Thus, even when coloring materials are contained in the fiber-containing materials, the coloring materials are removed from the fiber-containing materials by the particles supplied from the particle supply portion, and thereafter the coloring materials can also be removed together with the particles by the particle removal portion. Thus, the coloring materials can be quickly removed. Then, a sheet can be further manufactured from the fiber-containing materials from which the coloring materials are removed.

A processing method according to an aspect of the embodiment includes a fibrillation process of fibrillating fiber-containing materials containing fibers in the air, a particle supply process of supplying particles having Mohs' hardness of 2 or more and 5 or less to the fiber-containing materials during or after fibrillation for collision, and a particle removal process of removing the particles from the fiber-containing materials to which the particles are supplied.

Thus, even when coloring materials are contained in the fiber-containing materials, the coloring materials are removed from the fiber-containing materials by the particles supplied from the particle supply portion, and thereafter the coloring materials can also be removed together with the particles by the particle removal portion. Thus, the coloring materials can be quickly removed.

A method for manufacturing a sheet according to an aspect of the embodiment includes a fibrillation process of fibrillating fiber-containing materials containing fibers in the air, a particle supply process of supplying particles having Mohs' hardness of 2 or more and 5 or less to the fiber-containing materials during or after fibrillation for collision, and a particle removal process of removing the particles from the fiber-containing materials to which the particles are supplied, in which a sheet is manufactured from the fiber-containing materials from which the particles are removed.

Thus, even when the coloring materials are contained in the fiber-containing materials, the coloring materials are removed from the fiber-containing materials by the particles supplied from the particle supply portion, and thereafter the coloring materials can also be removed together with the particles by the particle removal portion. Thus, the coloring materials can be quickly removed. Then, a sheet can be further manufactured from the fiber-containing materials from which the coloring materials are removed.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A processing device comprising:

a raw material supply portion supplying fiber-containing materials containing fibers;

a fibrillation portion fibrillating the fiber-containing materials containing the fibers in air;

a particle supply portion supplying particles having Mohs' hardness of 2 or more and 5 or less to the fiber-containing materials during or after the fibrillating at the fibrillation portion for collision of the particles and the fiber-containing materials; and a particle removal portion removing the particles from the fiber-containing materials to which the particles are supplied in the particle supply portion, the particle supply portion containing a blower, the raw material supply portion being arranged upstream relative to the fibrillation portion, the particle supply portion, and the particle removal portion in a transporting direction of the fiber-containing materials, the particle supply portion connecting to the fibrillation portion, being disposed in the fibrillation portion, or being arranged downstream or upstream relative to the fibrillation portion in the transporting direction, the particle removal portion being arranged downstream relative to the fibrillation portion and the particle supply portion in the transporting direction.

2. The processing device according to claim 1, wherein the blower ejects the particles such that the fiber-containing materials contact the particles while the fiber-containing materials are being stirred by ejection of the particles.

3. The processing device according to claim 1, wherein the particle removal portion has a net-like body having an opening which allows passage of the particles but regulates passage of the fibers.

4. The processing device according to claim 1, wherein the particle removal portion is configured so as to remove the particles by centrifugal separation.

* * * * *